US005125609A

United States Patent [19]

Demeo

[11] Patent Number: 5,125,609

[45] Date of Patent: Jun. 30, 1992

[54] VERTICAL HOLDER FOR WALL COVERING ROLLS

[76] Inventor: Terenci G. Demeo, 335 West 14th Avenue, Vancouver, Canada, V5Y 1X3

[21] Appl. No.: 672,179

[22] Filed: Mar. 20, 1991

[51] Int. Cl.[5] ..... B65H 19/00

[52] U.S. Cl. ..... 248/216.1; 248/905; 248/309.2; 242/55.2

[58] Field of Search ..... 248/216.1, 309.2, 217.1, 248/905; 242/55.2

[56] References Cited

U.S. PATENT DOCUMENTS

| | | | |
|---|---|---|---|
| 428,203 | 5/1890 | Dugan | 242/55.2 |
| 492,975 | 3/1893 | Streeter | 242/55.2 X |
| 2,281,032 | 4/1942 | Galena | 242/55.2 |
| 2,707,595 | 5/1955 | Brown | 248 X/905 X |
| 4,263,347 | 4/1981 | Banta | 427/282 |
| 4,824,038 | 4/1989 | Chandler | 242/55.2 |
| 4,848,690 | 7/1989 | Lemoine | 242/55.54 |

FOREIGN PATENT DOCUMENTS

| | | | |
|---|---|---|---|
| 1437475 | 5/1971 | United Kingdom | 242/55.2 |

*Primary Examiner*—Alvin C. Chin-Shue
*Attorney, Agent, or Firm*—Norman M. Cameron

[57] ABSTRACT

A holder for a roll of wall covering. There is a top portion and a bottom portion which are connected by a member. A spindle is connected to one portion and extends towards the other portion. There is at least one needle-like projection extending outwardly from the front of the top portion. In use, the front of the top portion is against a wall with the projection inserted into the wall. The front of the bottom portion is against a wall below the top portion. The spindle is vertical with the roll rotatably received on the spindle.

7 Claims, 1 Drawing Sheet

VERTICAL HOLDER FOR WALL COVERING ROLLS

BACKGROUND OF THE INVENTION

1. Field of the Invention

This invention relates to a device for holding rolls of wall covering vertically while a strip of the wall covering is being applied to a wall.

2. Description of the Prior Art

Wall paper borders and other wall coverings conventionally come in cylindrical rolls. It is often an awkward task, sometimes requiring two persons, to unroll the wall covering from the roll and apply it to a wall. For example, one person may have to hold the roll and gradually move it from one corner of the wall towards another corner as the strip of wall covering is applied to the wall.

Attempts have been made to provide a device for holding a roll of wall covering and allowing a single person to apply it. For example, in U.S. Pat. No. 4,263,347 to Banta, a special pair of stilts have been provided, one of which has a holder for rotatably receiving a roll of masking material. The apparatus however would be relatively expensive and not everyone wants to wear stilts while applying wall coverings.

Vertical holders for rolled paper or similar materials are disclosed in U.S. Pat. No. 4,824,038 to Chandler and U.S. Pat. No. 4,848,690 to Lemoine. However, these devices are not suitable for holding rolls of wall paper, because they contemplate permanent fixation to a wall.

SUMMARY OF THE INVENTION

It is an object of the invention to provide a device which is capable of temporarily holding a roll of wall covering in a position on a wall, particularly one constructed of dry wall.

It is a further object of the invention to provide an improved holder for wall coverings which can be moved to different positions along a wall as a strip of wall covering is applied to the wall.

In accordance with these objects, the invention provides a holder for a roll of wall covering which includes a top portion having a front and a bottom portion having a front. A member connects the top portion and the bottom portion. A spindle is connected to one of the portions and extends toward the other portion. There is at least one needle-like projection extending outwardly from the front of the top portion. In use, the front of the top portion is against a wall with the projection inserted into the wall. The front of the bottom portion is against the wall below the top portion. The spindle is vertical with the roll of wall covering rotatably received thereon.

The invention is advantageous over the prior art in providing a simple, inexpensive device capable of holding a roll of wall covering, while a strip of the wall covering is being applied to the wall. The device can save considerable labor and cost when used to replace a second worker.

DESCRIPTION OF THE PREFERRED EMBODIMENTS

Figure 1:
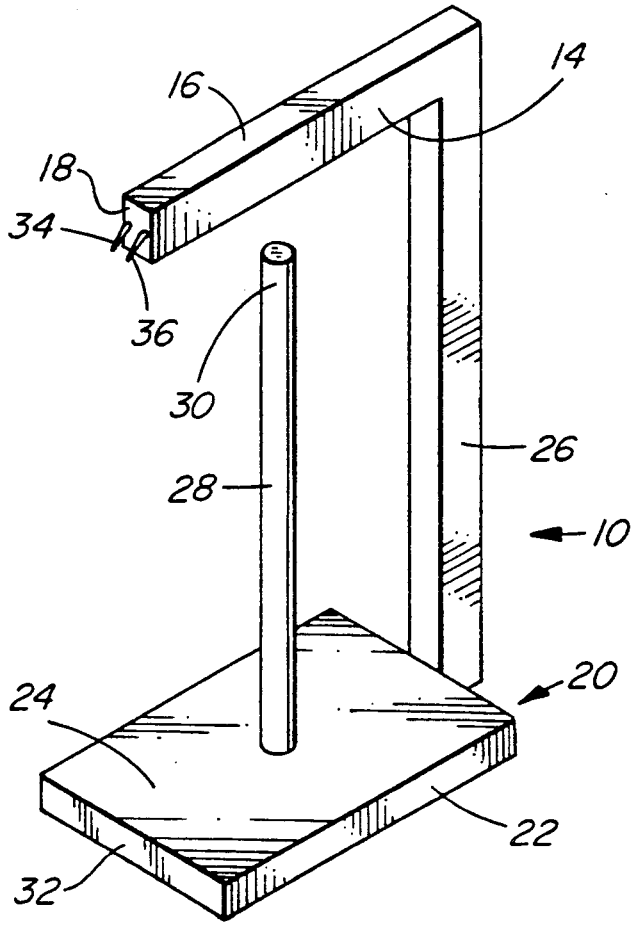
FIG. 1 is a top, front isometric view of a holder for a roll of wall covering, according to an embodiment of the invention.
Figure 3:
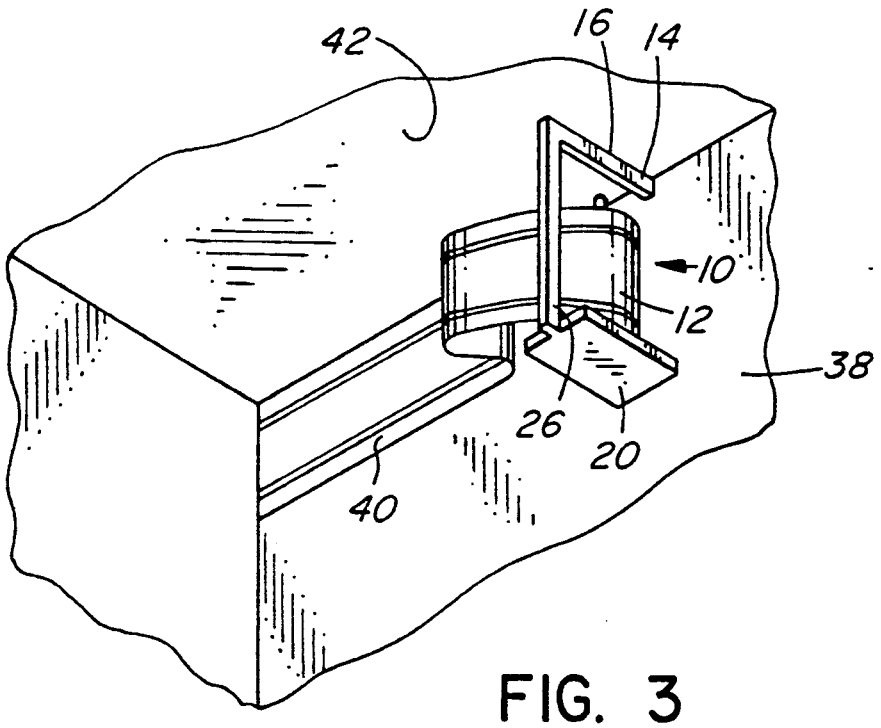
FIG. 3 is an isometric view showing a fragment of a wall and a holder as shown in FIG. 1 holding a roll of wall covering, while a strip of the wall covering is being applied to the wall.

FIG. 1 shows a holder 10 for a roll 12 of wall covering, shown only in FIG. 3. The holder has a top portion 14 which in this embodiment is an elongated member with a flat top 16 and front 18. Other configurations and shapes of top portions could be used instead.

The holder 10 also has a bottom portion 20 which includes a platform 22 having a top surface 24 for supporting roll 12 shown in FIG. 3. In this particular embodiment, the platform is rectangular, but other shapes, for example circular, and other configurations of bottom portions could be substituted.

An elongated member 26 rearwardly connects the top portion and bottom portion of the holder. In this embodiment the member is straight and similar in shape to the top portion, meeting it at right angles. However, other shapes and configurations could also be used in alternative embodiments.

A spindle 28 is connected to the bottom portion 20. In this example it is located centrally on platform 22 and extends upwardly, having a top 30 just below top portion 14. In this preferred example, the top portion 14, member 26, bottom portion 20 and spindle 28 are formed of a single piece of relatively rigid, but resilient plastic material, such as nylon. This allows the spindle 28 to be bent to one side to place roll 12 over the spindle. The spindle then returns to the initial position shown in FIG. 1. However, the device could be made of several pieces and the spindle could be removable to insert the roll or the top portion could be movable to allow the roll to be placed over the spindle. Alternatively, the spindle could be connected to the top portion and extend towards the bottom portion. Many other configurations are also possible.

The bottom portion 20 has a front 32 which projects outwardly from the position of the spindle on the platform. Likewise, the front 18 of top portion 14 projects outwardly from the top of the spindle. This gives clearance for the thickness of the roll of wall covering 12 and allows it to rotate when the fronts of the top and bottom portions contact a wall.

Figure 2:
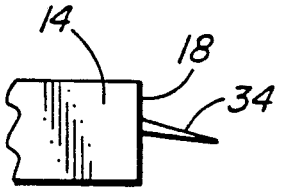
FIG. 2 is a fragmentary side elevation of the front of the top portion thereof and a needle-like projection extending therefrom.

There are two needle-like projections 34 and 36 connected to top portion 14 at the front 18 thereof. The projections have rear portions tightly received in apertures formed in the front of the top portion. As may be seen for projection 34 in FIG. 2, the projections are angled downwardly from the horizontal when the holder is positioned for use as shown. In the illustrated embodiment, the projections are angled about 10° downwardly, though the angle is not critical. In alternative embodiments, there could be a single projection, though two are preferred as shown. Additional projections could also be used, but are not necessary.

The holder 10 is primarily intended for use on a wall 38 made of dry wall as shown in FIG. 3. This is perhaps the most common material used at present to make walls and consists of a gypsum compound between layers of paper. Projections 34 and 36 are easily inserted into dry wall and cause no serious damage, leaving only small holes which are covered by the wall covering. The holder could also be used on some other types of walls made of softer materials, such as various fiber boards and soft wall panelling, but primarily it is intended for dry wall.

In use, the device is positioned between the corners of the wall. FIG. 3 shows it being used for applying a strip 40 of border material along the top of wall 38. The flat top 16 of the top portion is positioned against the ceiling 42. The strip 40 can then be unrolled and applied to the wall using the adhesive already applied to prepasted borders and pre-moistened by the user, or a separate adhesive for non-prepasted borders.

Once strip 40 has been secured as shown in the drawing, the user simply grasps the holder 10 and pulls it away from the wall, thus removing the projections from the wall. It can then be positioned further to the right, from the point of view of FIG. 3, and an additional strip of the wall covering can be applied to the wall. Of course it is also possible to start at the right corner and move to the left.

During use, it will be noted that the projections 34 and 36 are inserted into the wall until front 18 of the top portion contacts the wall. Front 32 of bottom portion 20 also contacts the wall.

It will be realized by someone skilled in the art that many of the details provided above are by way of example only and that many variations and alternatives are possible within the scope of the invention which is to be interpreted with reference to the following claims.

What is claimed is:

1. A holder for a roll of wall covering, comprising:

a top portion having a front;

a bottom portion having a front;

a member connecting the top portion and the bottom portion;

a spindle connected to one said portion and extending towards the other said portion; and at least one needle-like projection extending outwardly from the front of the top portion and being angled downwardly from the horizontal when the holder is positioned for use, whereby, in use, the front of the top portion is against a wall with said at least one said projection being inserted into the wall, the front of the bottom portion being against the wall below the top portion and the spindle being vertical with said roll of wall covering rotatably received thereon.

2. A holder as claimed in claim 1, wherein the fronts of the portions project outwardly beyond the spindle to provide clearance for the roll.

3. A holder as claimed in claim 1, wherein the bottom portion includes a platform having a top surface for supporting the roll, the spindle extending perpendicularly from the platform.

4. A holder as claimed in claim 1, wherein there are two said projections which are horizontally spaced-apart from each other when the holder is positioned for use.

5. A holder as claimed in claim 1, wherein the spindle is of a flexible material.

6. A holder as claimed in claim 1, wherein the holder, apart from the projections, is one piece of a resilient material.

7. A holder as claimed in claim 1, wherein the top portion and the member are elongated, the top portion being perpendicular to the member and having a top surface which is flat and horizontal when the holder is positioned for use.

* * * * *